US006554416B2

(12) United States Patent
Koto

(10) Patent No.: US 6,554,416 B2
(45) Date of Patent: Apr. 29, 2003

(54) IMAGE FORMING APPARATUS

(75) Inventor: Haruhiko Koto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/987,835

(22) Filed: Nov. 16, 2001

(65) Prior Publication Data

US 2002/0060705 A1 May 23, 2002

(30) Foreign Application Priority Data

Nov. 20, 2000 (JP) ..... 2000-353491

(51) Int. Cl.[7] ..... B41J 2/01
(52) U.S. Cl. ..... 347/104; 347/8; 347/4
(58) Field of Search ..... 347/104, 8; 400/635, 400/120.17; 271/276, 4, 55–57

(56) References Cited

U.S. PATENT DOCUMENTS 4,313,124 A 1/1982 Hara
4,345,262 A 8/1982 Shirato et al.
4,463,359 A 7/1984 Ayata et al.
4,723,129 A 2/1988 Endo et al.
5,757,389 A * 5/1998 Schwede et al. ..... 347/4
6,273,536 B1 * 8/2001 Nozawa ..... 347/8

* cited by examiner

*Primary Examiner*—John Barlow
*Assistant Examiner*—Ly T Tran
(74) *Attorney, Agent, or Firm*—Fitzpatrick, Cella, Harper & Scinto

(57) ABSTRACT

An image forming apparatus according to the present invention comprises a medium-conveyance device having a conveyance surface that moves at a speed V, and a plurality of liquid ejecting heads disposed in a movement direction of the surface. Associated with the maximum value of variations of a height of the surface with respect to a conveyance reference surface, the maximum error amount of a thickness of a print medium and the maximum amount of relief from the conveyance surface, the maximum height $H_{CX}$ of a cockling produced on the medium, and a cockling height after passage of a predetermined time L/V since a liquid is firstly ejected to the medium by the upstream liquid ejecting head, a gap between an ejection opening surface of the head located on the downstream side and the conveyance surface is set, and a distance L between the upstream and downstream liquid ejecting heads is set shorter than $(V/V_{CX})H_{CX}$.

15 Claims, 5 Drawing Sheets

IMAGE FORMING APPARATUS

This application is based on patent application Ser. No. 2000-353491 filed Nov. 20, 2000 in Japan, the content of which is incorporated hereinto by reference.

BACKGROUND OF THE INVENTION

1. Field of the Invention

The present invention relates to an image forming apparatus provided with a plurality of full line heads, relative positions of which are fixed, upon a liquid droplet being ejected onto a print medium, the print medium moving by adsorption conveyance such as suction or electrostatic adsorption as medium conveyance, and more particularly relates to solving problems associated with a cockling produced on the print medium to which the liquid is applied.

2. Description of the Prior Art

A cockling occurring on a sheet of paper that is a kind of a printing medium on which liquid droplets are applied, i.e., deformation due to water imbibition by fibers is conventionally recognized as a difficulty against liquid ejection and printed image formation. The difficulty has been recognized in a serial scan type printer (hereinafter, simply referred to as a serial system) using a carriage that moves with respect to the suspended medium while placing thereon a liquid ejecting head. Japanese Patent Application Laid-open No. 6-115068 discloses a method of solving the difficulty with the prior art wherein a rib for permitting a cockling to occur on the medium is formed on a plate shaped structure for holding in contact a medium back surface called a platen.

In a system (hereinafter referred to a full-line system) where upon ejecting liquid droplets a full-line type head is employed with a ejection opening disposed over the entire width of a print medium to convey the print medium, floating of the print medium itself upon conveyance is a problem rather than the amount of displacement of the print medium caused by the foregoing cockling. In the full-line system, many inventions on how securely adsorption and conveyance are performed have been applied. For example, Japanese Patent Application Laid-open Nos. 7-53081, 7-133035, and 9-254460 disclose a fact that a print medium is adsorbed to a platen with the aid of suction or static electricity.

A main technique of the prior art concerns such a platen structure that cockling produced even in the serial system may be allowed in a print region. It is the present situation in the full-line system that even a problem of the cockling itself has not been recognized much.

SUMMARY OF THE INVENTION

The present invention is to pursue optimum print conditions by clarifying correlations among respective components of an image forming apparatus capable of realizing high image quality with the aid of ejecting of liquid droplets by achieving clarification of a cockling itself not known conventionally. The present invention is further to complete a novel system capable of achieving optimum printing for a cockling.

More specifically, it is an object of the present invention to provide a novel optimum design method capable of determining requirements of the whole of an image forming apparatus by investigating a relationship among respective components from the occurrence of cockling in the aforementioned full-line system.

It is another object of the present invention to provide an image forming apparatus capable of achieving high image quality without being affected by cockling while utilizing an optimum printing gap by setting a relationship among the respective components without being affected by characteristics (surface tension, etc.) of horizontally ejecting a liquid such as an ink and characteristics of a print medium itself such as paper, which are both dominating stages of occurrence and growth of the cockling in the full-line system.

It is a further object of the present invention to provide an optimum image forming apparatus with all of the variations of the foregoing respective elements.

The present inventors have investigated variously a change in cockling height with respect to the time elapsed since application of liquid droplets by pursuing an occurrence mechanism of the cockling in an adsorptive conveyance system with respect to a change in the cockling produced owing to a difference among kinds of ink and a difference among its invasion characteristics or a difference among its infiltrate characteristics, and further differences among fibers of the print medium used and sizing agents. It has been hereby found that if the adsorptive conveyance system is employed for a time shorter than 1 second after application of liquid droplets, any cockling is substantially not produced on any print medium or with any ink. It is considered that the reason is that the mechanism of the occurrence of the cockling is due to infiltration of water constituting the ink. It has been also found that beyond one second after the application of liquid droplets, the height of the cockling is changed in response to the characteristics of each ink and the print medium. FIG. 2 illustrates this change, in which cockling heights $H_C$ (mm) are on the y axis and the time $T_D$ elapsed is on the x axis, which time elapsed takes the time of application of liquid droplets as the origin, i.e., "0". Coordinates Y(1, γ) indicate a reference point with γ=0.05 in water ink. Such use of γ is convenient to clarify applicability of the present invention, because γ changes only slightly, even when other ink systems are employed or even though ink characteristics developed hereafter, if any, change in particular. In any case, a curved line indicating a change in cockling heights $H_C$ after the elapsed time $T_D$=1 (sec) is as illustrated in FIG. 2.

In accordance with one view of the present invention, a tangential line $H_C=\alpha T_D+\beta$ with respect to the curved line passing through the reference point Y(1, γ) passes through (1, γ), from which curved line α, β, and γ can be in turn determined. A choice may be made as a matter of course by a maker of a print medium that provides such a curved line upon design of the print medium by the maker. It is herein preferable to take as an object a print medium that ensures a maximum cockling. If ink used is already determined, then the reference point Y(1, γ) in the individual image forming apparatus is defined by itself.

For the adsorptive conveyance means there may be typically used one in electrostatic adsorption conveyance and suction conveyance described later, in which a print medium is brought into close contact with a conveyor such as a moving belt, the accuracy of which means is practically uniform.

However, even if use is made of a belt with reduced accuracy and an adsorption system with reduced cling properties in order to reduce the manufacturing cost, the present invention can complete printing in a region where the amount of occurrence of the cockling is more reduced than the prior art. There is therefore ensured an image with higher quality than the prior art image forming apparatus without disturbance of the image by "rubbing".

The present invention discloses items where technical idea of the present invention is developed while taking such manufacturing and practical error fractions into consideration.

Referring here to FIG. 3, a conceptual view of a portion of the image forming apparatus illustrated in FIG. 1 is provided, which defines a head existing region (its length L). The head existing region in the present invention is defined from a ejection opening A of a head section 13B where printing is first performed up to an end B of a head section 13Y (an end which is capable of making contact with the print medium) where printing is finally performed.

A practical print system according to the present invention is adapted such that an image forming apparatus comprises:

medium-conveying means for attracting and conveying a print medium having a characteristic with which cockling is produced by application of liquid droplets;

attracting means for attracting the print medium to the medium-conveying means; and a first liquid ejecting head for first providing liquid droplets on the upstream side in the direction of conveyance of the print medium, and a second liquid ejecting head for finally providing liquid droplets on the downstream side, the first and second ejecting heads being separated from the print medium with a gap, wherein for a slope $\alpha$ and an intercept $\beta$ obtained from a tangential line to a curved line which the tangential line passes through an x-y reference point (1, 0.05) obtained from the curved line in an x-y coordinate system, the curved line representing the height (y) mm of the cockling in response to the time (x) elapsed since the application of liquid droplets onto the print medium, a minimum gap H (mm) in the gap, the length L (mm) of a ejecting head existence region extending from an ejecting portion of the first liquid ejecting head up to an end of the second liquid ejecting head, and a conveyance speed V (mm/sec) of the print medium satisfy an equality:

$$H>\alpha(L/V)+\beta, \text{ with } H\geqq 0.05 \text{ and } \alpha+\beta=0.05.$$

This is proper conditions obtained in water ink used at present.

It should be noticed that an x-y reference point (1, 0.05) of the practical print system is indicated as (1, $\gamma$), whereby the foregoing conditions are capable of employing $\gamma$ as a value corresponding to "0.05", which is thus represented as a technical idea capable of also dealing with a change in ink characteristics which will be considered hereafter.

As understood from the curved line shown in FIG. 2, the time "1 sec. or less" after the ejection and application of liquid droplets is optimum conditions for high image quality, so that it is more preferable to satisfy an inequality $V\geqq L$.

Taking variations and error of each parameter into consideration, the present invention is collected as the following mode. An ejecting speed of liquid droplets is 8 to 10 meters or more per second, so that variations of an impact position on calculation can be ignored.

Another aspect of the present invention is in an image forming apparatus comprising:

medium-conveying means having a conveyance surface for moving at a speed V along a conveyance reference surface to convey a print medium; and at least two liquid ejecting heads disposed at a distance in the movement direction of the conveyance surface and respectively having an ejection opening surface through which a plurality of ejection openings are opened for ejecting a liquid, the image forming apparatus forming an image by ejecting the liquid onto the surface of the print medium from the ejection opening of the liquid ejecting head disposed oppositely to the conveyance surface, wherein an interval between the ejection opening surface of an arbitrary second liquid ejecting head located downstream first liquid ejecting head located upstream in the movement direction of the conveyance surface for firstly ejecting the liquid to the print medium and the conveyance surface is smaller than the total sum of the maximum value of variations of the height of the conveyance surface with respect to the conveyance reference surface, the maximum error amount of the thickness of the print medium and the maximum amount of relief from the conveyance surface, and the maximum height $H_{CX}$ of cockling produced on the print medium owing to the liquid ejected onto the surface of the print medium, and is set to be larger than the total sum of the maximum value of variations of the height of the conveyance surface with respect to the conveyance reference surface, the maximum error amount of the thickness of the print medium and the maximum amount of relief from the conveyance surface, and the height $H_{C1}$ of the cockling produced on the print medium after the elapse of predetermined time $T_{C1}$ since first ejection of the liquid to the print medium from the first liquid ejecting head, and wherein a distance L between the first liquid ejecting head and the second liquid ejecting head is set shorter than $(V/V_{CX})H_{CX}$ when the maximum value of the growth speed of the cockling is represented by $V_{CX}$, and further the predetermined time $T_{C1}$ being L/V.

Further another aspect of the present invention is in an image forming apparatus comprising:

medium-conveyance means having a conveyance surface that moves at a speed V along a conveyance reference surface to convey a print medium; and at least two liquid ejecting heads each having ejection opening surfaces through which a plurality of ejection openings are disposed, separated away in the movement direction of the conveyance surface and are opened to eject a liquid, whereby the liquid is ejected to the surface of the print medium from the ejection openings of the liquid ejecting head facing the conveyance surface to form an image, wherein a gap between the ejection opening surface of an arbitrary second liquid ejecting head located more downstream than a first liquid ejecting head located on an upstream side in the movement direction of the conveyance surface for firstly ejecting the liquid to the print medium and the conveyance surface is set smaller than the total sum of the maximum value of variations of the height of the conveyance surface with respect to the conveyance reference surface, the maximum error amount of the thickness of the print medium and the maximum amount of relief from the conveyance surface, and the cockling height $H_{C2}$ when the growth speed is maximum of the cockling after the liquid is firstly ejected to the print medium from the first liquid ejecting head, and is set larger than the total sum of the maximum of variations of the height of the conveyance surface with respect to the conveyance reference surface, the maximum error amount of the thickness of the print medium and the maximum amount of relief from the conveyance surface, and the height $H_{C1}$ of the cockling produced on the print medium after the elapse of a predetermined time $T_{C1}$ since the liquid is firstly ejected to the print medium from the first liquid ejecting head, and wherein a distance L between the first liquid ejecting head and the second liquid ejecting head is set to be shorter than $(V/V_{CX})$ when the maximum value of the growth speed of the cockling is represented by $V_{CX}$, and further the predetermined time $T_{C1}$ being L/V.

Still another aspect of the present invention is in an image forming apparatus comprising:

medium-conveyance means having a conveyance surface moved at a speed V along a conveyance reference surface to convey a print medium; and at least two liquid ejecting heads each having a ejection opening surfaces which are disposed, separated away from each other in the movement direction of the conveyance surface and through which a plurality of ejection openings are opened each for ejecting a liquid, whereby the liquid is ejected from the ejection openings of the liquid ejecting head facing the conveyance surface onto the surface of the print medium to form an image, wherein a gap between the conveyance surface and the ejection opening surface of an arbitrary second liquid ejecting head located more downstream than a first liquid ejecting head located on the upstream side in the movement direction of the conveyance surface for firstly ejecting the liquid onto the print medium is set smaller than the total sum of the maximum value of variations of the height of the conveyance surface with respect to the conveyance reference surface, the maximum error amount of the thickness of the print medium and the maximum amount of relief from the conveyance surface, and a cockling height $H_{C3}$ at a time $T_{C3}$ which is calculated on the basis of the maximum value $V_{CX}$ of the growth speed of the cockling produced on the print medium since the liquid is first ejected onto the print medium through the first liquid ejecting head and when a difference between the cockling height $H_{C3}$ and the actual cockling height is maximum, and is set larger than the total sum of the maximum value of variations of the height of the conveyance surface with respect to the conveyance reference surface, the maximum error amount of the thickness of the print medium and the maximum amount of relief from the conveyance surface, and a cockling height $H_{C1}$ produced on the print medium after the passage of predetermined time $T_{C1}$ since the liquid is firstly ejected onto the print medium by the first liquid ejecting head, and wherein a distance L between the first liquid ejecting head and the second liquid ejecting head is set shorter than $V \cdot T_{C3}$, and the predetermined time $T_{C1}$ being L/V.

In this situation, the cockling height $H_{C3}$ at the time $T_{C3}$ estimated on the basis of the maximum growth speed $V_{CX}$ of the cockling is about 0.3 mm, and the time $T_{C3}$ is about 1.1 sec.

Still further aspect of the present invention is in an image forming apparatus comprising:

medium-conveyance means having a conveyance surface; and at least two liquid ejecting heads each having ejection opening surfaces which are disposed, separated away from each other in the movement direction of the conveyance surface and through which a plurality of ejection openings are opened for ejecting a liquid, whereby the liquid is ejected onto the surface of the print medium from the ejection openings of the liquid ejecting heads facing the conveyance surface to form an image, wherein an interval between the conveyance surface and the ejection opening surface of an arbitrary second liquid ejecting head located downstream of a first liquid ejecting head which is located on the upstream side in the movement direction of the conveyance surface is set smaller than the total of the maximum of variations of the height of the conveyance surface with respect to the conveyance reference surface, the maximum error amount of the thickness of the print medium and the maximum amount of relief from the conveyance surface, and the maximum height $H_{CX}$ of the cockling produced on the print medium owing to the liquid ejected on the print medium, and is set larger than the total sum of the maximum of variations of the height of the conveyance surface with respect to the conveyance reference surface, the maximum error amount of the thickness of the print medium and the maximum amount of relief from the conveyance surface, and the height $H_{C4}$ of the cockling after the passage of predetermined time $T_C$, which is calculated on the basis of the maximum value $V_{CX}$ of the growth speed of the cockling and since the liquid is firstly ejected to the print medium by the first liquid ejecting head, and wherein a distance between the first liquid ejecting head and the second liquid ejecting head is set shorter than $(V/V_{CX})H_{CX}$, and further the predetermined time $T_{C1}$ being L/V.

In the image forming apparatus according to the present invention, the liquid may be aqueous, and the print medium may be a non-coated sheet of paper. The plurality of the ejection openings may be arranged over the entire width of a print region of the print medium that intersects the movement direction of the conveyance surface.

The distance between the first liquid ejecting head and the second liquid ejecting head located most downstream may be less than 75 mm, the movement speed V of the conveyance surface may be more than 300 mm/s, the gap between the ejection opening surface of the second liquid ejecting head and the surface of the print medium may be less than 0.4 mm.

The medium-conveyance means may include a conveyance belt. Alternatively, the medium-conveyance means may include a revolving drum, an external peripheral surface of which serves as the conveyance surface.

In accordance with the present invention, the height of the cockling grown on the print medium is predicted in response to the time elapsed after the liquid is firstly ejected on the print medium, on the basis of which a distance between an ejection opening surface of the liquid ejecting head and a conveyance surface of then same is set, and an interval between the liquid ejecting heads arranged in the conveyance direction of the print medium is set in response to the movement speed of the conveyance surface, so that the cockling produced on the print medium is prevented from making contact with the ejection opening surface of the liquid ejecting head, and further the distance between the ejection opening surface of the liquid ejecting head and the conveyance surface can be set to a necessary minimum, whereby image quality can be more improved than in a prior art multi-line printer.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Although an embodiment will be described below in which an image forming apparatus according to the present invention is applied to an ink jet printer with reference to the accompanying drawings, it is a matter of course that the present invention is not limited to such embodiments but is applicable to other techniques to be involved in the idea of the present invention as disclosed in claims in the present specification.

Figure 1:
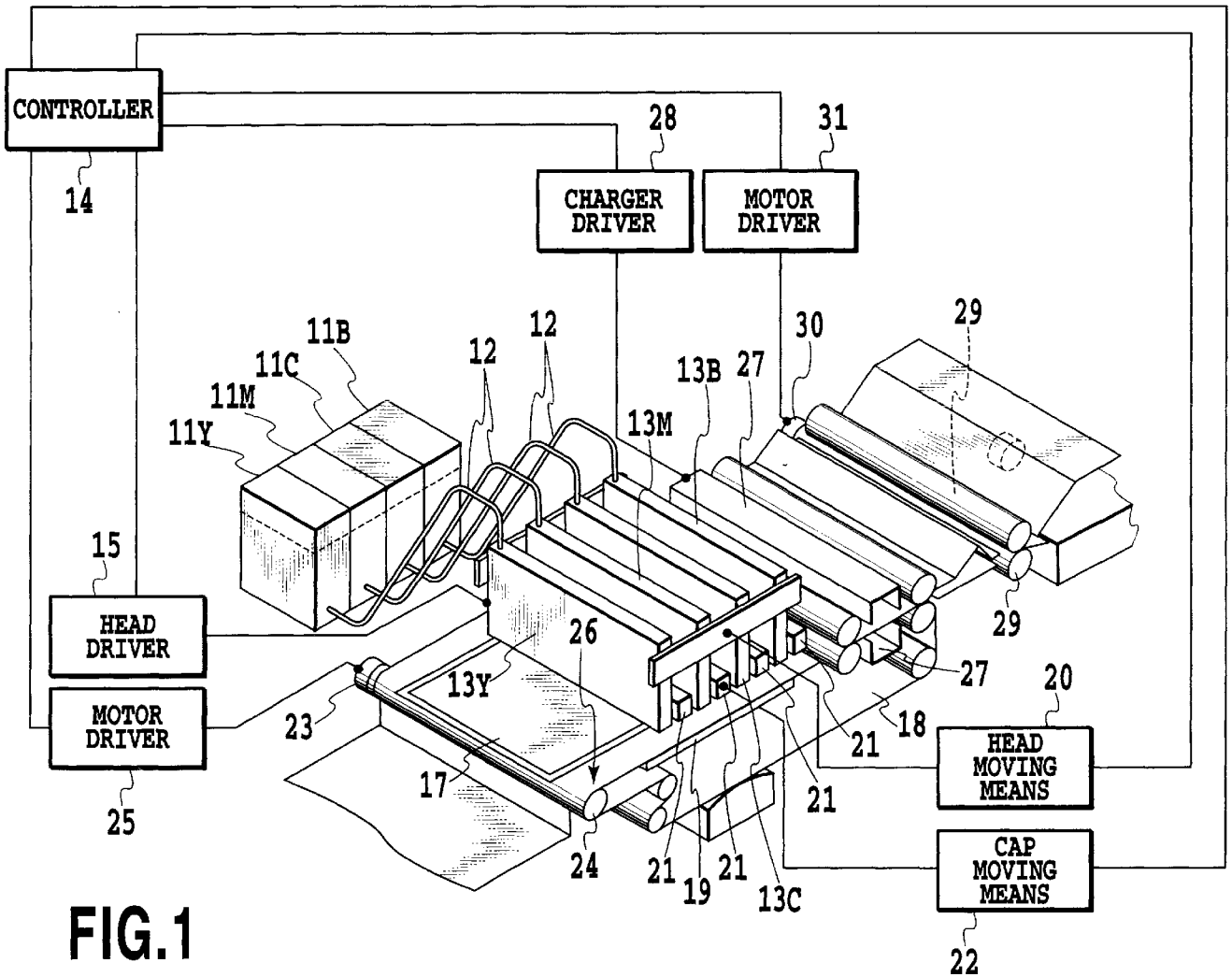
FIG. 1 is a schematic of an embodiment wherein an image forming apparatus according to the present invention is applied to a full-line type ink jet printer.
Figure 2:
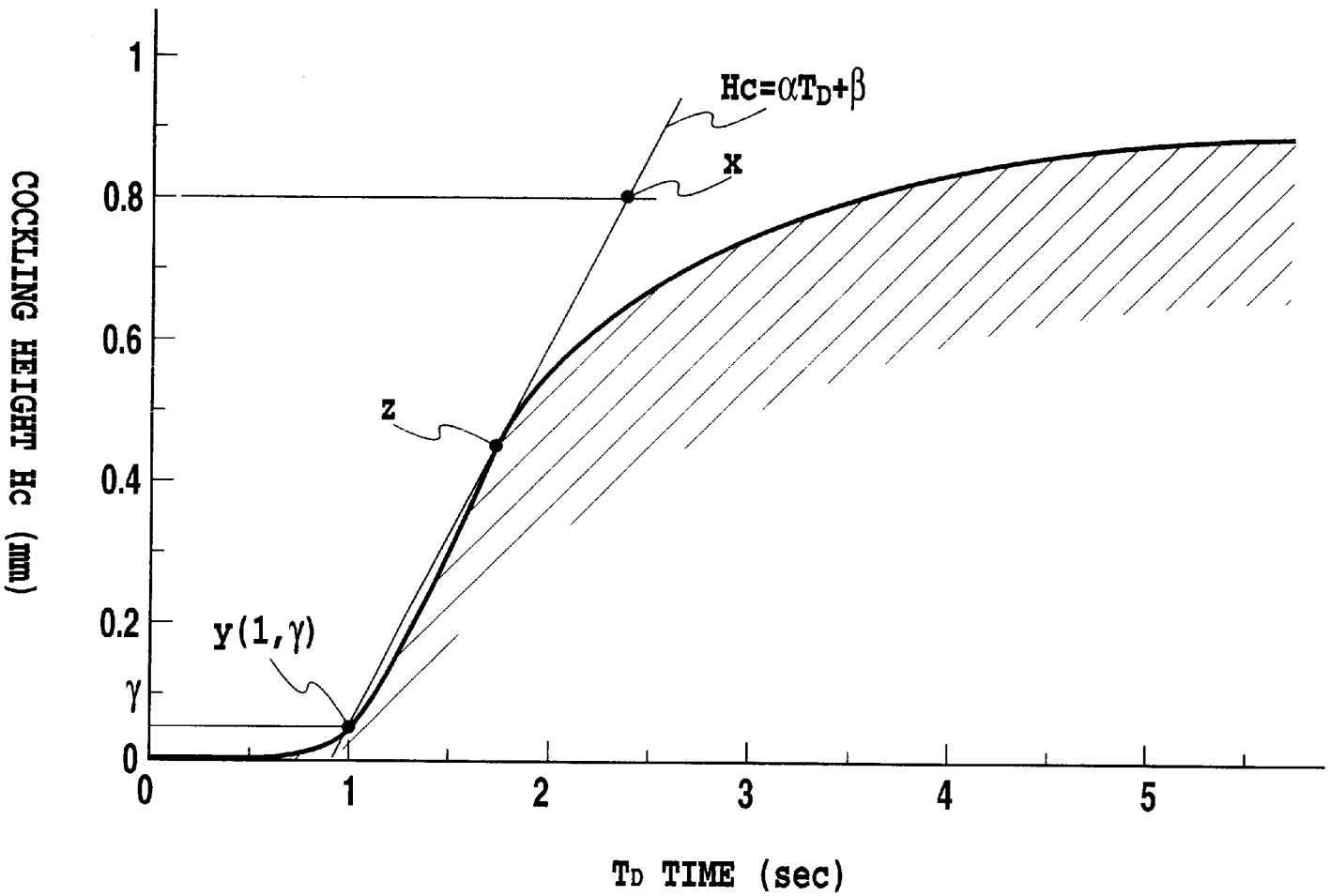
FIG. 2 is a graphic representation illustrating a curved line of a change in the height of cockling produced on a print medium in order to describe the principle of the present invention.
Figure 3:
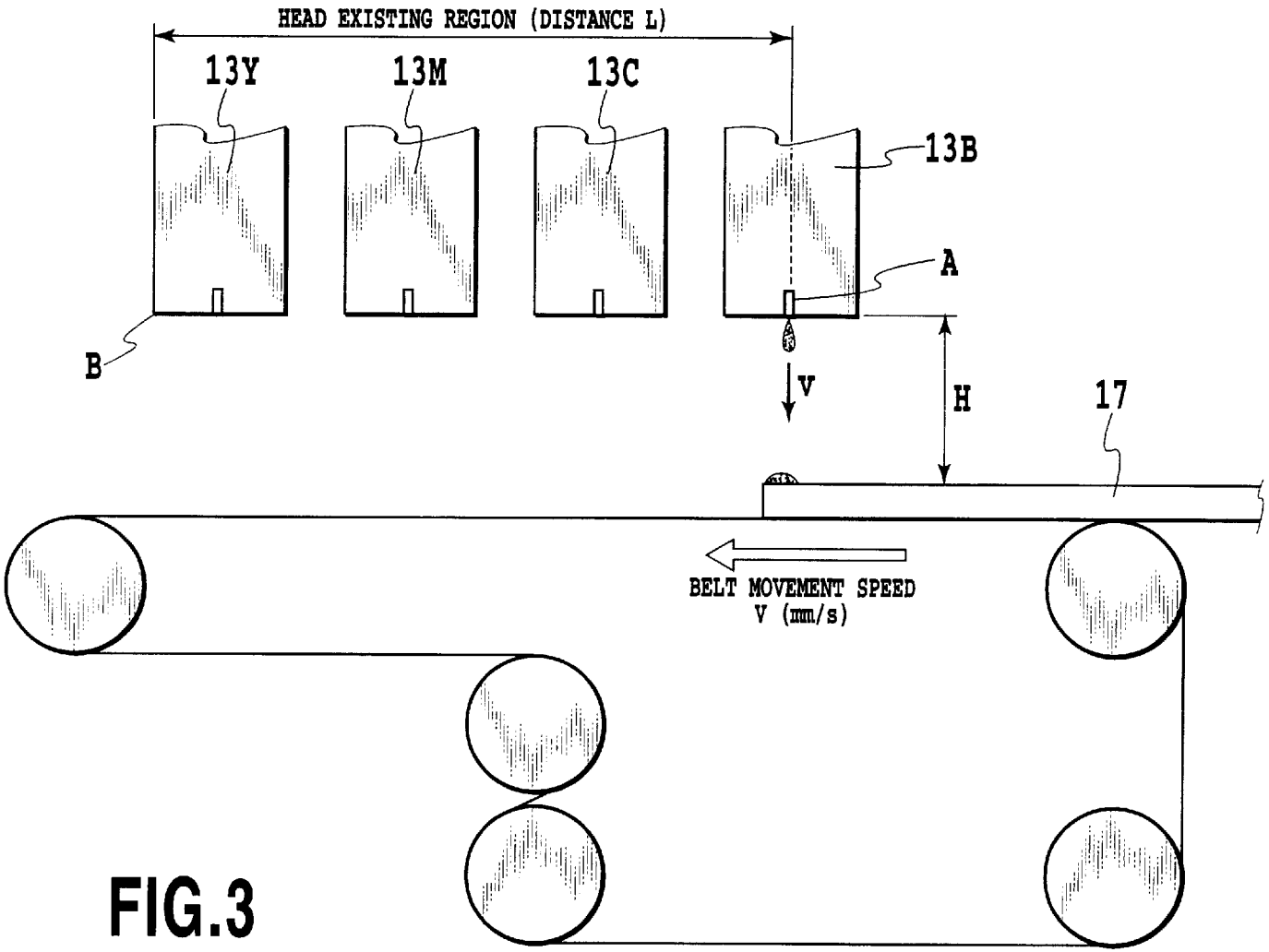
FIG. 3 is an enlarged view illustrating a relationship between an individual ink jet head and a conveyance system of a print medium in the embodiment illustrated in FIG. 1.
Figure 4:
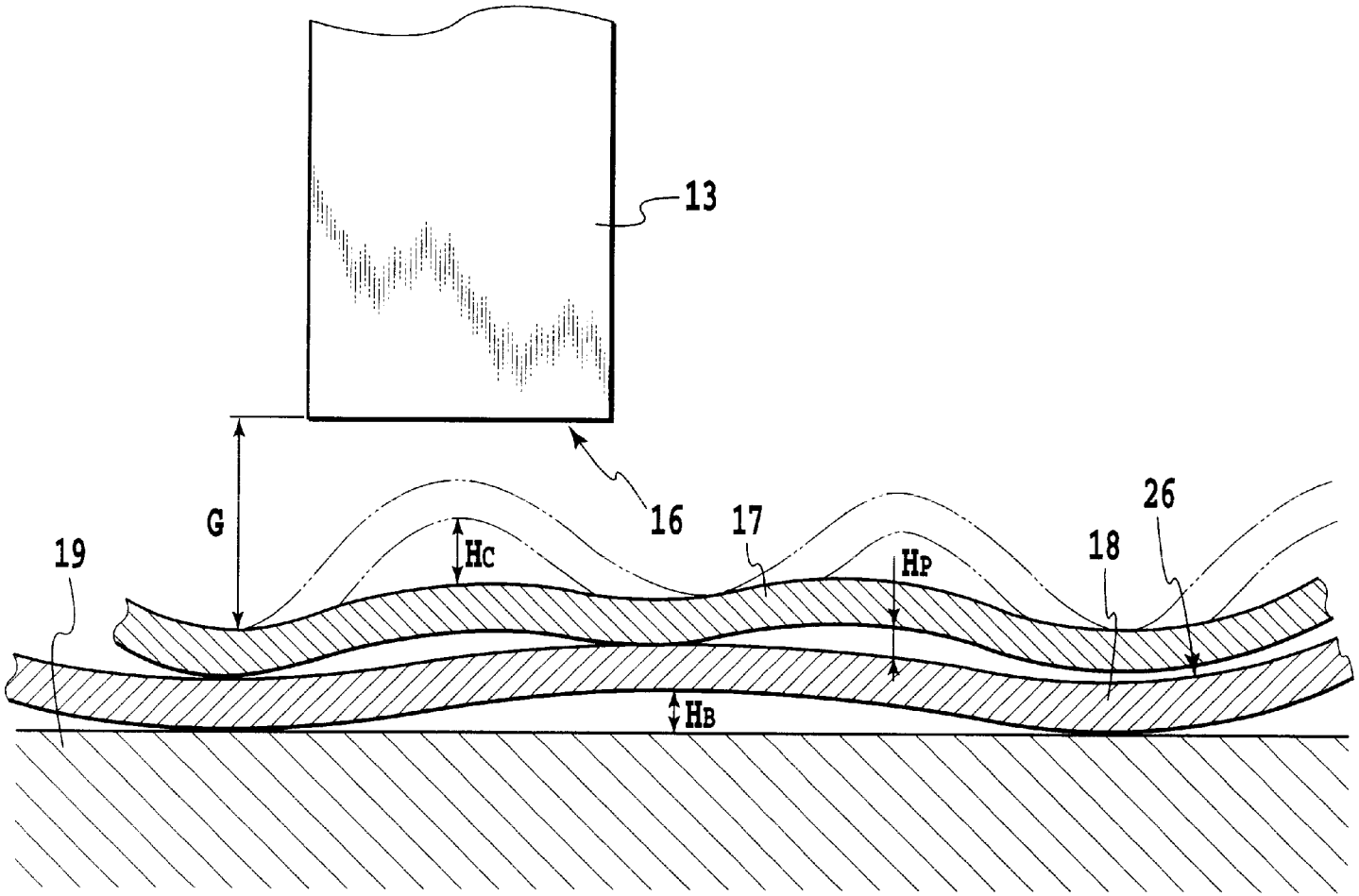
FIG. 4 is a view illustrating a relationship among a ejection opening surface of the ink jet head, the print medium, and a platen in the embodiment in FIG. 1.

Referring now to FIG. 1, an external appearance of an ink jet printer in the present embodiment is illustrated; and referring further to FIG. 4, a relationship between an arbitrary ink jet head and part of the medium-conveyance means is illustrated. The ink jet printer of the present embodiment is the so-called full line type color printer. The ink jet cartridge includes four ink tanks 11Y, 11M, 11C, and 11B (hereinafter simply referred together to ink tanks 11.) in which there are stored yellow ink, magenta ink, cyan ink, and black ink respectively, and four ink jet heads 13Y, 13M, 13C, and 13B (hereinafter simply referred together to ink jet heads 13.) where ink supply tubes are connected to the ink tanks 11 respectively through connection pipings 12. The ink tank 11 is connected with the connection pipings 12 exchangeably.

On/off operation of electric power supply to an electrothermal converter device (not shown) of the ink jet heads 13 is switched by a head driver 15 connected to a controller 14. The ink jet heads 13 are arranged at a predetermined interval in the direction of conveyance of a conveyance belt 18 such that the ejection opening surfaces 16 face the surface of a platen serving as a conveyance reference surface of the present invention while putting an endless conveyance belt 18 for conveying print sheet of paper 17 as the print medium. A plurality of ejection openings (not shown) are opened in ejection opening surface 16 of each ink jet heads 13 for ejecting ink. These ejection openings are arranged over the entire width of a print region of the print sheet of paper 17 extended perpendicularly to the movement direction of the conveyance belt 18. The ink jet heads 13 is moved elevatably in the opposite direction to the platen 19 between the print position located in the vicinity of the conveyance belt 18 and a withstand position separated from the conveyance belt 18 with the aid of head moving means 20 for recovery processing, operation of which is controlled by the controller 14.

A distance between the ejection opening surface 16 and the print sheet of paper 17 discussed in the present invention is that between a portion of the ejection opening surface 16 located in close vicinity to the print sheet of paper 17 and the print sheet of paper 17. The ejection opening surface 16 may be formed with a flat surface, which is flush with the surface of the platen 19. It is also possible to form an ejection opening which is recessed, for the purpose of protecting the ejection opening.

Head caps 21 are displaced by half pitch with respect to an arrangement distance of the ink jet heads 13 on the side of the ink jet heads 13 for recovering, prior to the printing work on the print sheet of paper 17, the ink jet heads 13 by ejecting old ink existing in an ink passage (not shown) formed in the ink jet heads 13 from the ink ejection opening. These head caps 21 are moved to a portion just under the respective ink jet heads 13 with the aid of the cap moving means 22 that is controlled in its operation by the controller 14, to receive waste ink ejected from the ink ejection opening.

The conveyance belt 18 for conveying the print sheet of paper 17 is wound around the driving roller 24 coupled with the belt driving motor 23. The conveyance belt 18 is switched in its operation by the motor driver 25 connected to the controller 14. Upstream the conveyance belt 18 a charger 27 is provided for bringing the print sheet of paper 17 to close contact with the surface 26 of the conveyance belt 18, i.e. the conveyance surface of the present invention. The charger 27 is switched in on/off of power supply thereto by the charger driver 28 connected to the controller 14. To a pair of paper feed rollers 29 for supplying the print paper 17 on the conveyance belt 18 a paper feed motor 30 is coupled for rotating the pair of the paper feed rollers 29. The paper feed motor 30 is switched in its operation by the motor driver 31 connected to the controller 14.

Prior to the printing work on the print sheet of paper 17 the ink jet heads 13 are raised so as to be separated from the platen 19. Then, the head caps 21 are moved to a portion just under the ink jet heads 13 to perform the recovering of the ink jet heads 13. Thereafter, the head caps 21 are moved to an original waiting position. Further, the ink jet heads 13 are moved to the side of the platen 19 up to the printing position. The charger 27 is actuated and simultaneously the conveyance belt 18 is driven. The print sheet of paper 17 is fed onto the conveyance belt 18 by the paper feed roller 29 to permit a predetermined color image to be printed on the print sheet of paper 17 by the ink jet heads 13.

Figure 5:
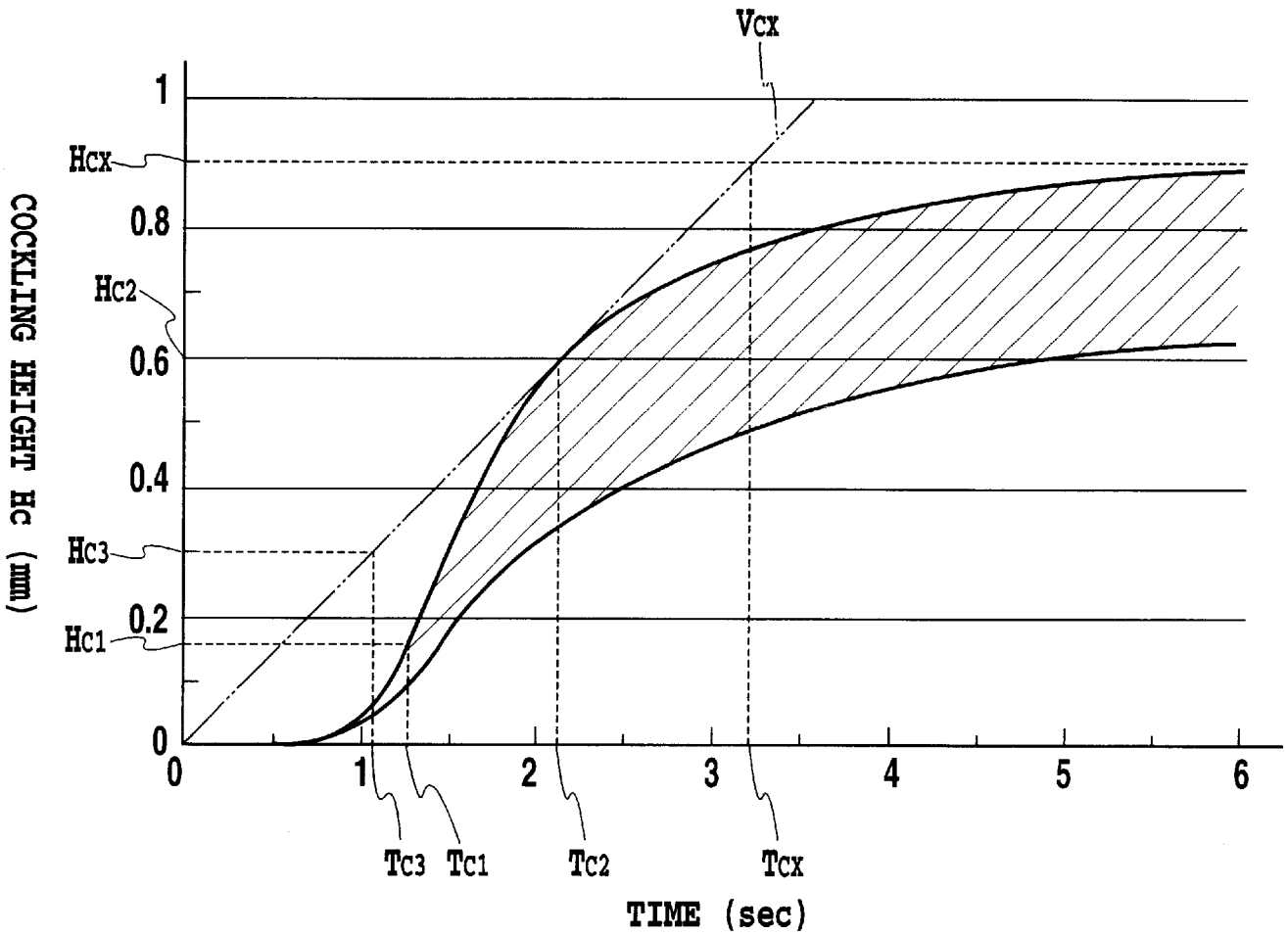
FIG. 5 is a graphic representation illustrating a relationship between the time elapsed after ink is ejected on the print medium and the height of the cockling produced on the print medium.

When ink adheres to the surface of the print sheet of paper 17, water in the ink is absorbed by cellulose constituting the print sheet of paper 17, and wrinkle called the cockling is formed owing to a reason of the cellulose being swelled. Referring to FIG. 5, there is provided a relationship between the time elapsed since the ejection of ink onto the print sheet of paper 17 from the ejection opening of an arbitrary ink jet heads 13 and the height $H_C$ of the cockling produced on the print sheet of paper 17. The height $H_C$ of the cockling slightly varies, depending upon the kinds of the print sheet of paper 17, compositions of ink, the amount of ink ejected to the same position on the print sheet of paper 17. The height illustrated in FIG. 5 shows a situation where 200% ink implantation to a general copying machine ordinary paper is performed, i.e., operation of ejecting a predetermined amount of liquid droplets at a predetermined position of the print sheet of paper 17 are performed two times. It is obvious from FIG. 5 that although the cockling height $H_C$ increases with the time elapsed, it has a plateau after the elapse of about 6 sec or more.

Upon discussion of the gap between the ejection opening 16 and the print paper 17, a maximum side of variations of the cockling height $H_C$ indicated by a hatched region in FIG. 5 may be considered from the viewpoint of safety. Accordingly, the cockling height $H_C$ in the present embodiment takes as an object a curved line indicated by a solid line on the maximum side.

The cockling height $H_C$ between the print sheet of paper 17 and the ejection opening surface 16 of the ink jet heads 13Y for ejecting yellow ink located on the most downstream side in the direction of the movement of the conveyance belt 18 depends upon the time elapsed of ejection from the ink jet heads 13B, 13C, and 13M for ejecting of black, cyan, and magenta ink located on the more upstream side of the print sheet of paper 17. The time elapsed of ejection from the ink jet heads 13C and 13M for ejecting of cyan and magenta ink, which are located on the more downstream side than the ink jet heads 13B for ejecting of black colored ink located on the most upstream side in the direction of movement of the conveyance belt 18, is shorter than the time elapsed of ejection from the ink jet heads 13B for ejecting of black colored ink. Therefore the time elapsed of ejection from the ink jet heads 13B for ejecting of black colored ink may be substantially considered.

Although the aforementioned platen 19 is made of metal and can be regarded as a rigid body, it has variations of about ±0.05 mm with respect to a conveyance reference surface owing to assembling error when it is assembled into a casing not shown. Further, variations of the thickness of the conveyance belt 18 slidable on the platen are suppressed to several micrometers. The conveyance belt is however obstructed from completely making close contact with the surface of the platen 19 owing to an influence of a wrinkle, etc., which causes floating $H_B$ from the surface of the platen 19. The floating $H_B$ is about maximum 0.2 mm. Further, the thickness of the print sheet of paper 17 generally is about 0.1 mm, depending on the kind thereof. Further, even if the print sheet of paper 17 is kept attracted to the surface 26 of the conveyance belt 18 owing to static electricity, relief $H_P$ from the surface 26 of the conveyance belt 18 happens owing to rigidity of the print sheet of paper 17, the size of which relief is a maximum of about 0.02 mm. The position of the ejection opening surface 16 of the ink jet heads 13 varies by about ±0.03 mm owing to its assembling error. Therefore, the maximum cumulative error is about 0.4 mm. Accordingly, in the case where a margin of 0.1 mm is provided for the gap G between the ejection opening surface 16 of the ink jet heads 13 and the print sheet of paper 17, and no cockling is produced on the print sheet of paper 17, the gap G between the ejection opening surface 16 of the ink jet heads 13 and the print sheet of paper 17 can be set to 0.5 mm to ensure relatively excellent print quality.

However, such cockling as illustrated in FIG. 5 is actually produced on the print sheet of paper 17, so that in the prior art the maximum cockling height $H_{CX}$, e.g. 0.9 mm is added and the gap G between the ejection opening surface 16 of the ink jet heads 13 and the print sheet of paper 17 is set to about 1.4 mm. A full multi-type ink jet printer in which image formation is achieved by one passage, therefore suffers from a difficulty in image quality as described previously.

In the first embodiment of the present invention, the gap G between the ejection opening surface 16 of the ink jet heads 13 and the print sheet of paper 17 can be set to a value described below which is less than the aforementioned 1.4 mm. That is, when the distance between the ink jet heads 13B for ejecting of black ink located on a most upstream side and the ink jet heads 13Y for ejecting of yellow ink located on most downstream side is assumed to be L, and the movement speed of the conveyance belt 18 is assumed V, the time $T_{C1}$ until an image printed with the ink jet heads 13B for ejecting of black ink reaches the ink jet heads 13Y for ejecting of yellow ink can be represented as:

$$T_{C1}=L/V \tag{1}$$

The actual cockling height $H_{C1}$ corresponding to the time $T_C$, calculated from the equation (1) is obtained from FIG. 5. It is preferable that the gap G between the ejection opening surface 16 of the ink jet heads 13Y and the print sheet of paper 17 is larger than $(0.4+H_{C1})$ mm, and particularly that it has a margin of 0.1 mm for example such that ink droplets or paper fibers and dust adhering to the ejection opening surface 16 are prevented from making contact with the print sheet of paper 17, so that the actual cockling height $H_{C1}$ may be set to be $(0.5+H_{C1})$ mm or more.

The maximum value of the cockling height $H_{C1}$ in the present embodiment becomes the maximum cockling height $H_{CX}$. Time $T_{CX}$ when the maximum cockling height $H_{CX}$ is attained at the maximum cockling growth speed $V_{CX}$ is set to the maximum of the aforementioned time $T_{C1}$. The growth of the cockling after the time $T_{CX}$ when the maximum cockling height $H_{CX}$ is attained at the maximum cockling growth speed $V_{CX}$ is very gradual, and hence the gap G between the ejection opening surface 16 of the ink jet heads 13 and the print sheet of paper 17 might be set to the minimum obtained by calculation, there would happen the possibility of the print sheet of paper 17 making contact with the ink jet heads 13.

It is possible to set narrower the gap G between the ejection opening surface 16 of the most downstream side ink jet heads 13Y and the print sheet of paper 17 by speeding up the movement speed V of the conveyance belt 18 and setting shorter the distance L between the most upstream side ink jet heads 13B and the most downstream side ink jet heads 13Y. For example, when the movement speed V of the conveyance belt 18 is set to about 300 mm/s, and the distance L between the most upstream side ink jet heads 13B and the most downstream side ink jet heads 13Y is set to 75 mm for example (a distance between the adjacent ink jet heads 13 is set to 25 mm.), the time $T_{C1}$ becomes 0.25 sec from the equation (1). Referring here to FIG. 5, it is obvious that the cockling height $H_{C1}$ produced on the print sheet of paper 17 passing through a portion just under the ejection opening surface 16 of the most downstream side ink jet heads 13Y grows only about 0.01 mm, so that the gap G between the ejection opening surface 16 of the most downstream side ink jet heads 13Y and the print sheet of paper 17 can be set to about 0.4 mm or about 0.5 mm leaving a margin. Hereby, it is possible to more sharply improve arrival accuracy of an ink droplet and hence image quality than the prior art. Since the print sheet of paper 17 passes through just under the ejection opening surface 16 of the ink jet heads 13 without making any contact with the ejection opening surface 16 of the ink jet heads 13, a very excellent quality image is ensured.

The gap G between the ejection opening surface 16 and the print sheet of paper 17 can be narrowed by speeding up the movement speed V of the conveyance belt 18 and setting shorter the distance L between the most upstream side ink jet heads 13B and the most downstream side ink jet heads 13Y.

A lower limit value of the cockling height $H_C$ illustrated in FIG. 5 is determined by the growth curve of the cockling.

When yellow ink, magenta ink, cyan ink, and black ink have super permeability through the print sheet of paper 17, even if the respective ink jet heads 13 are disposed in close vicinity with each other, it is possible to comparatively suppress mixing among the respective color inks on the print sheet of paper 17.

When the movement speed V of the conveyance belt 18 is not speeded up, and when the distance L between the most upstream side ink jet heads 13B and the most downstream side ink jet heads 13Y becomes longer, there are some cases where the cockling height reaches the maximum cockling height $H_{CX}$. However, if the present time can be made shorter than a time $T_{C2}$ (≐2.2 sec.) corresponding to a contact point between the maximum value $V_{CX}$ of the cockling growth speed, i.e. a curved line indicating the degree of the growth of the cockling height $H_C$ actually produced in FIG. 5 and a straight line that is tangential and passes through the origin, the maximum value of the cockling height $H_{C1}$ can be suppressed to a cockling height $H_{C2}$ corresponding to the time $T_{C2}$. For example, when the distance L between the ink jet heads 13B for ejecting of black ink and the ink jet heads 13Y for ejecting of yellow ink is 75 mm, then it is necessary to set the cockling growth speed to V≧34 (mm/s) from the equation (1). Under these conditions the gap G between the ejection opening surface 16 of the most downstream ink jet heads 13Y for ejecting of yellow ink and the print sheet of paper 17 can be set to 1.0 mm by adding the cockling height $H_{C2}$ of about 0.6 mm to cumulative error of about 0.4 mm, which is due to variations of about ±0.05 mm with respect to the conveyance reference surface of the foregoing platen 19, several μm variations of the thickness of the conveyance belt 18, $H_B$ from the surface of the platen 19, i.e. relief of 0.2 mm, variations of about 0.1 mm of the thickness of the print sheet of paper 17, $H_P$ of the print sheet of paper 17 from the surface 26 of the conveyance belt 18, e.g. relief of about 0.02 mm, and variations of about ±0.03 mm of the positions of the ejection opening surface 16 of the ink jet heads 13. Also in this case, it is desirable to have a margin of 0.1 mm so as to prevent ink droplets or paper fibers and dust adhering to the ejection opening surface 16 from adhering to the print sheet of paper 17.

Therefore, it is possible to more improve deposition accuracy of an ink droplet and hence image quality than in the prior art. Particularly, since the cockling height $H_C$ before the time $T_{C2}$ grows rapidly, if the conveyance speed corresponding to the growth speed is secured, then even though the growth speed of the cockling is thereafter varied, a change in the cockling itself is small, and hence the possibility of the print sheet of paper 17 making contact with the ejection opening surface 16 of the ink jet heads 13 is very little.

In a third embodiment, for further improving the image quality, the cockling height $H_{C3}$ at a time $T_{C3}$ when the difference with the actual cockling height $H_C$ is maximum, which cockling height $H_{C3}$ is calculated on the basis of the maximum value $V_{CX}$ of the growth speed of the cockling, is utilized as an upper limit value for setting the gap G between the ejection opening surface 16 of the ink jet heads 13 and the print sheet of paper 17. To be concrete, the movement speed V of the conveyance belt 18 and/or the foregoing length L are/is set such that before the time $T_{C2}$, when the cockling growth speed becomes maximum, the present time becomes less than a time $T_{C3}$, when a difference between the cockling height $H_{C3}$ calculated on the basis of the maximum value $V_{CX}$ of the cockling growth speed, and the actual cockling height $H_C$ is large, in other words, less than the time $T_{C3}$ at a contact point between a straight line parallel to the maximum value $V_{CX}$ of the growth speed of the cockling and the cockling growth curved line. To be concrete, in the case of L of 75 mm, the cockling height $H_{C3}$ can be made about 0.3 mm (refer to FIG. 5.) or less by bringing the movement speed V of the conveyance belt 18 to be 75 mm/s or more. As a result, the gap G between the ejection opening surface 16 of the ink jet heads 13 and the print sheet of paper 17 can be narrowed to 0.7 mm or lower to ensure an excellent quality image.

In the present embodiment, the actually produced cockling height $H_{C1}$ is surely smaller than the cockling height $H_{C3}$ supposed on the basis of the maximum value $V_{CX}$ of the growth speed of the cockling as exhibited in the equation (2), so that the possibility of the contact between the ejection opening surface 16 and the surface of the print sheet of paper 17 can be further reduced.

The movement speed V of the conveyance belt 18 is raised and $T_{C1}$=1 (sec.) is set, whereby the cockling height $H_{C1}$ growing at this time point can be made 0.02 mm or less, so that the gap G between the ejection opening surface 16 of the ink jet heads 13 and the print sheet of paper 17 can be further narrowed. In order to keep the ejection opening surface 16 of the ink jet heads 13 and the conveyance reference surface unchanged at all times, a spacer serving to keep the interval therebetween intact at all times is provided, protruded onto the ink jet heads 13 for example, and the ink jet heads 13 are energized such that the tip end of the spacer abuts the conveyance reference surface of the platen 19. Hereby, even if the flatness of the conveyance reference surface of the platen 19 is bad, such can be compensated, and hence variations of a maximum of about 0.08 mm can be reduced to 0.01 mm. It is also possible to reduce variations of the thickness of the print sheet of paper 17 from 0.1 mm to 0.05 mm by providing a paper thickness sensor for detecting the thickness of the print sheet of paper 17 and inserting a gap adjusting plate between the ejection opening surface 16 of the ink jet heads 13 and the platen 19 in response to a detection result. As a result, accumulation of these variations becomes 0.28 mm, and the gap G between the discharge surface 26 of the ink jet head 17 including the cockling height $H_C$ and the print sheet of paper 17 becomes the minimum of 0.3 mm, and becomes 0.4 mm even with a margin for ink droplets adhering to the ejection opening surface 16 or paper fibers and dust to result in a further excellent quality image.

In the aforementioned three embodiments, it is necessary to previously sample the growth process of the actually produced cockling height $H_{C1}$. In a fourth embodiment of the present invention, a lower limit of the gap G between the ejection opening surface 16 of the ink jet heads 13 and the print sheet paper 17 is set by making use of the cockling height $H_{C4}$ calculated on the basis of the maximum value $V_{CX}$ of the cockling growth speed. More specifically, the maximum growth speed $V_{CX}$ of the cockling is supposed to be the cockling height, and the height $H_{C4}$ of the cockling after passage of the time $T_{C1}$ calculated on the basis of the maximum growth speed $V_{CX}$ of the cockling in FIG. 5, more specifically on the basis of the maximum value of a change rate of the height $H_{C1}$ of the cockling growing after black ink ejected from the ink jet heads 13B for ejecting of black color adheres to the print sheet of paper 17 is set to satisfy $$H_{C4}=(V_{CX}\times T_{C1}) \quad (2)$$

L and V are determined from the equation (1), and simultaneous equations (1), (2) are solved to set the gap G between the ejection opening surface 16 of the ink jet heads 13Y and the print sheet paper 17 to be $(0.4+H_{C4})$ or more, particularly set the gap to $(0.5+H_{C4})$ mm or more since it is preferable that ink droplets or paper fibers and dust adhering to the ejection opening surface 16 are prevented from making contact with the print sheet of paper 17, e.g. a margin of 0.1 mm for example is provided. But, the margin is preferable to be 0.2 mm or lower. Accordingly, the foregoing gap G is effective to be $(0.6+H_{C4})$ mm or less.

In the aforementioned respective embodiments, four ink jet heads 13 respectively for ejecting four colored inks are arranged at an equal distance. It is however possible to employ two ink jet heads of an ink jet head for ejecting of color ink, i.e. yellow ink, magenta ink, and cyan ink, and the ink jet heads 13B for ejecting of black color. The ink jet head for ejecting of color ink includes on its ejection opening surface a ejection opening group for ejecting of yellow ink, a ejection opening group for ejecting of magenta ink, and a ejection opening group for ejecting of cyan ink, all opened located in close vicinity. Therefore, the gap between the ink jet head for ejecting of color ink and the surface of the conveyance belt 18 can be set narrower. Although there was described an example using the conveyance belt 18 that utilizes electrostatic adsorption as the medium-conveyance means, there may be adopted one type that attracts directly the print sheet of paper 17 to an external peripheral surface of a cylindrical drum. It is also possible to utilize adsorption by vacuum as means to hold the print sheet of paper 17 on the conveyance surface. In the case where the cylindrical drum is adopted, the gap between the ink jet head and the print sheet of paper can be set further narrower by a fraction corresponding to the amount of relief of the aforementioned conveyance belt 18.

The present invention achieves distinct effect when applied to the image forming apparatus which has means for generating thermal energy such as electrothermal transducers or laser beam, and which causes changes in ink by the thermal energy so as to eject liquid. This is because such a system can achieve a high density and high-resolution printing.

A typical structural and operational principle thereof is disclosed in U.S. Pat. Nos. 4,723,129 and 4,740,796, and it is preferable to use this basic principle to implement such a system. Although this system can be applied either to on-demand type or continuous type ink jet printing systems, it is particularly suitable for the on-demand type apparatus. This is because the on-demand type apparatus has electrothermal transducers, each disposed on a sheet or liquid passage that retains liquid, and operates as follows: firstly, one or more driving signals are applied to the electrothermal transducers to cause thermal energy corresponding to printing information; secondly, the thermal energy induces sudden temperature rise that exceeds the nucleate boiling so as to cause the film boiling on heating portions of the liquid ejecting head; and thirdly, bubbles are grown in the liquid corresponding to the driving signals. By using the growth and collapse of the bubbles, the ink is expelled from at least one of the ejecting ports of the head to form one or more liquid drops. The driving signal in the form of a pulse is preferable because the growth and collapse of the bubbles can be achieved instantaneously and suitably by this form of driving signal. As the driving signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better printing.

It is further preferable to add a recovery system for ejecting liquid from the ejecting head in adequate condition, or a preliminary auxiliary system for a liquid ejecting head as a constituent of the image forming apparatus because they serve to make the effect of the present invention more reliable. Examples of the recovery system are a capping means and a cleaning means for the liquid ejecting head, and a pressure or suction means for the liquid ejecting head. Examples of the preliminary auxiliary system are a preliminary heating means utilizing electrothermal transducers or a combination of other heater elements and the electrothermal transducers, and a means for carrying out preliminary ejection of liquid independently of the ejection for printing. These systems are effective for reliable printing.

The number and type of liquid ejecting heads to be attached on an image forming apparatus can be also detached. For example, only one liquid ejecting head corresponding to single color ink, or a plurality of liquid ejecting heads corresponding to a plurality of inks different in color or concentration can be used. In other words, the present invention can be effectively applied to an apparatus having at least one of the monochromatic, multi-color and full-color modes. Here, the monochromatic mode performs printing by using only one major color such as black. The multi-color mode carries out printing by using different color inks, and the full-color mode performs printing by color mixing. In this case, the treatment liquid (the printablity enhanced liquid) for adjusting the printablity of the ink may also be ejected from each individual heads or a common ejecting head to the printing medium in accordance with a kind of the printing medium or the printing mode.

The present invention is most effective when it uses the film-boiling phenomenon to expel the liquid.

Furthermore, the image forming apparatus according to the present invention can be employed not only as an image output terminal of an information processing device such as a computer, but also as an output device of a copying machine combined with a reader or the like, a facsimile apparatus having a transmission and receiving function, or a printing press for cloth. A sheet or web paper, a wooden or plastic board, a stone slab, a plate glass, a metal sheet, a three dimensional structure or the like may be used as the printing medium according to the present invention.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

What is claimed is:

1. An image forming apparatus comprising:

medium-conveying means for attracting and conveying a print medium having a characteristic with which cockling is produced by application of liquid droplets;

attracting means for attracting the print medium to said medium-conveying means; and a first liquid ejecting head for first providing liquid droplets on the upstream side in the direction of conveyance of the print medium, and a second liquid ejecting head for later providing liquid droplets on the downstream side, said first and second ejecting heads being separated from the print medium with a gap, wherein for a slope $\alpha$ and an intercept $\beta$ obtained from a tangential line to a curved line which the tangential line passes through an x-y reference point (1, 0.05) obtained from the curved line in an x-y coordinate system, the curved line representing the height (y) mm of the cockling in response to the time (x) elapsed since the application of liquid droplets onto the print medium, a minimum gap H (mm) in the gap, the length L (mm) of an ejecting head existence region extending from an ejecting portion of said first liquid ejecting head up to an end of said second liquid ejecting head, and a conveyance speed V (mm/sec) of the print medium satisfy an inequality:

$$H>\alpha(L/V)+\beta, \text{ with } H\geqq 0.05 \text{ and } \alpha+\beta=0.05.$$

2. An image forming apparatus comprising:

medium-conveying means for attracting and conveying a print medium having a characteristic with which cockling is produced by application of liquid droplets;

attracting means for attracting the print medium to the medium-conveying means; and a first liquid ejecting head for first providing liquid droplets on the upstream side in the direction of conveyance of the print medium, and a second liquid ejecting head for later providing liquid droplets on the downstream side, said first and second ejecting heads being separated from the print medium with a gap, wherein for a slope $\alpha$ and an intercept $\beta$ obtained from a tangential line to a curved line which the tangential line passes through an x-y reference point (1, $\gamma$) obtained from the curved line in an x-y coordinate system, the curved line representing the height (y) mm of the cockling in response to the time (x) (second) elapsed since the application of liquid droplets onto the print medium, a minimum gap H (mm) in the gap, the length L (mm) of an ejecting head existence region extending from an ejecting portion of said first liquid ejecting head up to an end of said second liquid ejecting head, and a conveyance speed V (mm/sec) of the print medium satisfy an inequality:

$$H>\alpha(L/V)+\beta, \text{ with } H\geqq\gamma \text{ and } \alpha+\beta=\gamma.$$

3. An image forming apparatus according to claim 1 or 2, wherein $0.8\geqq H$ is satisfied.

4. An image forming apparatus according to claim 1 or 2, wherein the print medium providing the curved line is a print medium providing the maximum cockling amount among usable media.

5. An image forming apparatus according to claim 1 or 2, wherein the conveyance speed V (mm/sec) satisfies relationship of $V\geqq L$ where the print medium is forced to pass through the length L (mm) of said ejecting head existing region for 1 sec or less.

6. An image forming apparatus comprising:

medium-conveyance means having a conveyance surface for moving at a speed V along a conveyance reference surface to convey a print medium; and at least two liquid ejecting heads disposed at a distance in the movement direction of the conveyance surface and respectively having an ejection opening surface through which a plurality of ejection openings are opened for ejecting a liquid, said image forming apparatus forming an image by ejecting the liquid onto the surface of the print medium from the ejection opening of said liquid ejecting head disposed oppositely to the conveyance surface, wherein an interval is defined between the ejection opening surface of an arbitrary second liquid ejecting head located downstream of a first liquid ejecting head located upstream in the movement direction of the conveyance surface for firstly ejecting the liquid to the print medium and the conveyance surface, the inverval is set smaller than the total sum of the maximum value of variations of the height of the conveyance surface with respect to the conveyance reference surface, the maximum error amount of the thickness of the print medium and the maximum amount of relief from the conveyance surface, and the maximum height $H_{CX}$ of cockling produced on the print medium owing to the liquid ejected onto the surface of the print medium, and the interval is set to be larger than the total sum of the maximum value of variations of the height of the conveyance surface with respect to the conveyance reference surface, the maximum error amount of the thickness of the print medium and the maximum amount of relief from the conveyance surface, and the height $H_{C1}$ of the cockling produced on the print medium after the elapse of predetermined time $T_{C1}$ since first ejection of the liquid to the print medium from said first liquid ejecting head, and wherein a distance L between said first liquid ejecting head and said second liquid ejecting head is set shorter than $(V/V_{CX})H_{CX}$ when the maximum value of the growth speed of the cockling is represented by $V_{CX}$, and further the predetermined time $T_{C1}$ being L/V.

7. An image forming apparatus comprising:

medium-conveyance means having a conveyance surface that moves at a speed V along a conveyance reference surface to convey a print medium; and at least two liquid ejecting heads each having ejection opening surfaces through which a plurality of ejection openings are disposed, separated in the movement direction of the conveyance surface and being opened to eject a liquid, whereby the liquid is ejected to the surface of the print medium from the ejection openings of said liquid ejecting head facing the conveyance surface to form an image, wherein a gap is defined between the ejection opening surface of an arbitrary second liquid ejecting head located on a more downstream side than a first liquid ejecting head located on an upstream side in the movement direction of the conveyance surface for firstly ejecting the liquid to the print medium and the conveyance surface.

the gap is set smaller than the total sum of the maximum value of variations of the height of the conveyance surface with respect to the conveyance reference surface, the maximum error amount of the thickness of the print medium and the maximum amount of relief from the conveyance surface, and the cockling height $H_{C2}$ when the growth speed is maximum of the cockling after the liquid is firstly ejected to the print medium from said first liquid ejecting head, and the gap is set larger than the total sum of the maximum of variations of the height of the conveyance surface with respect to the conveyance reference surface, the maximum error amount of the thickness of the print medium and the maximum amount of relief from the conveyance surface, and the height $H_{C1}$ of the cockling produced on the print medium after the elapse of a predetermined time $T_{C1}$ since the liquid is firstly ejected to the print medium from said first liquid ejecting head, and wherein a distance L between said first liquid ejecting head and said second liquid ejecting head is set to be shorter than $(V/V_{CX})$ when the maximum value of the growth speed of the cockling is represented by $V_{CX}$, and further the predetermined time $T_{C1}$ being L/V.

8. An image forming apparatus comprising:

medium-conveyance means having a conveyance surface moved at a speed V along a conveyance reference surface to convey a print medium; and at least two liquid ejecting heads having ejection opening surfaces which are disposed separated from each other in the movement direction of the conveyance surface and through which a plurality of ejection openings are opened, each for ejecting a liquid, whereby the liquid is ejected from the ejection openings of said liquid ejecting head facing the conveyance surface onto the surface of the print medium to form an image, wherein a gap is defined between the conveyance surface and the ejection opening surface of an arbitrary second liquid ejecting head located more downstream than a first liquid ejecting head located on the upstream side in the movement direction of the conveyance surface for firstly ejecting the liquid onto the print medium, the gap is set smaller than the total sum of the maximum value of variations of the height of the conveyance surface with respect to the conveyance reference surface, the maximum error amount of the thickness of the print medium and the maximum amount of relief from the conveyance surface, and a cockling height $H_{C3}$ at a time $T_{C3}$ which is calculated on the basis of the maximum value $V_{CX}$ of the growth speed of the cockling produced on the print medium since the liquid is firstly ejected onto the print medium through said first liquid ejecting head and when a difference between the cockling height $H_{C3}$ and the actual cockling height is maximum, and the gap is set larger than the total sum of the maximum value of variations of the height of the conveyance surface with respect to the conveyance reference surface, the maximum error amount of the thickness of the print medium and the maximum amount of relief from the conveyance surface, and a cockling height $H_{C1}$ produced on the print medium after the passage of predetermined time $T_{C1}$ since the liquid is firstly ejected onto the print medium by said first liquid ejecting head, and wherein a distance L between said first liquid ejecting head and said second liquid ejecting head is set shorter than $V \cdot T_{C3}$, and the predetermined time $T_{C1}$ being L/V.

9. An image forming apparatus according to claim 8, wherein the time $T_{C3}$ is more advanced than a time $T_{C2}$ when the growth speed of the cockling indicates the maximum value $V_{CX}$, and the height $H_{C3}$ of the cockling at the time $T_{C3}$ is 0.3 mm.

10. An image forming apparatus comprising:

medium-conveyance means having a conveyance surface; and at least two liquid ejecting heads having ejection opening surfaces which are disposed separated from each other in the movement direction of the conveyance surface and through which a plurality of ejection openings are opened for ejecting a liquid, whereby the liquid is ejected onto the surface of the print medium from the ejection openings of said liquid ejecting heads facing the conveyance surface to form an image, wherein an interval is defined between the conveyance surface and the ejection opening surface of an arbitrary second liquid ejecting head located downstream of a first liquid ejecting head which is located on the upstream side in the movement direction of the conveyance surface, the interval is set smaller than the total of the maximum of variations of the height of the conveyance surface with respect to the conveyance reference surface, the maximum error amount of the thickness of the print medium and the maximum amount of relief from the conveyance surface, and the maximum height $H_{CX}$ of the cockling produced on the print medium owing to the liquid ejected on the print medium, and the interval is set larger than the total sum of the maximum of variations of the height of the conveyance surface with respect to the conveyance reference surface, the maximum error amount of the thickness of the print medium and the maximum amount of relief from the conveyance surface, and the height $H_{C4}$ of the cockling after the passage of predetermined time $T_{C1}$ which is calculated on the basis of the maximum value $V_{CX}$ of the growth speed of the cockling and since the liquid is firstly ejected to the print medium by said first liquid ejecting head, and wherein a distance between the first liquid ejecting head and said second liquid ejecting head is set shorter than $(V/V_{CX})H_{CX}$, and further the predetermined time $T_{C1}$ being L/V.

11. An image forming apparatus according to any one of claims 1, 2, 6 to 8, and 10, wherein the liquid is aqueous, and the print medium is a non-coated sheet of paper.

12. An image forming apparatus according to any one of claims 6 to 8 and 10, wherein the plurality of the ejection openings are arranged over the entire width of a print region of the print medium that intersects the movement direction of the conveyance surface.

13. An image forming apparatus according to any of claims 6 to 8 and 10, wherein the distance between said first liquid ejecting head and said second liquid ejecting head located most downstream is less than 75 mm, the movement speed V of the conveyance surface is more than 300 mm/s, and the gap between the ejection opening surface of said second liquid ejecting head and the surface of the print medium is less than 0.4 mm.

14. An image forming apparatus according to any one of claims 6 to 8 and 10, wherein the medium-conveyance means includes a conveyance belt.

15. An image forming apparatus according to any one of claims 6 to 8 and 10, wherein the medium-conveyance means includes a revolving drum, an external peripheral surface of which serves as the conveyance surface.

* * * * *

UNITED STATES PATENT AND TRADEMARK OFFICE

CERTIFICATE OF CORRECTION

PATENT NO. : 6,554,416 B2
DATED : April 29, 2003
INVENTOR(S) : Koto

It is certified that error appears in the above-identified patent and that said Letters Patent is hereby corrected as shown below:

Column 1,
Line 31, “to” should read -- to as --.

Column 5,
Line 16, “a” should be deleted.

Column 6,
Line 59, “then same” should read -- the print medium --.

Column 8,
Line 66, “ink, the” should read -- ink and the --.

Column 12,
Line 1, “$T_{C3}$,” should read -- $T_{C3}$ --.
Line 2, “$H_{C3}$” should read -- $H_{C3}$, --.

Column 16,
Line 48, “surface.” should read -- surface, --.

Signed and Sealed this

Eleventh Day of November, 2003

JAMES E. ROGAN
*Director of the United States Patent and Trademark Office*